US008795069B2

(12) United States Patent
Causley

(10) Patent No.: US 8,795,069 B2
(45) Date of Patent: Aug. 5, 2014

(54) GAMING MACHINE BONUS

(76) Inventor: Peter Causley, Sydney (AU)

( * ) Notice: Subject to any disclaimer, the term of this patent is extended or adjusted under 35 U.S.C. 154(b) by 0 days.

(21) Appl. No.: 13/107,837

(22) Filed: May 13, 2011

(65) Prior Publication Data

US 2012/0289322 A1 Nov. 15, 2012

(51) Int. Cl.
*A63F 9/00* (2006.01)

(52) U.S. Cl.
USPC ..... 463/26

(58) Field of Classification Search
None
See application file for complete search history.

(56) References Cited

U.S. PATENT DOCUMENTS

| | | | | |
|---|---|---|---|---|
| 6,210,275 | B1 * | 4/2001 | Olsen | 463/16 |
| 6,776,711 | B1 * | 8/2004 | Baerlocher | 463/16 |
| 7,029,395 | B1 * | 4/2006 | Baerlocher | 463/20 |
| 7,052,392 | B2 * | 5/2006 | Tessmer et al. | 463/16 |
| 7,235,009 | B2 * | 6/2007 | Baerlocher | 463/16 |
| 7,959,508 | B2 * | 6/2011 | Gauselmann | 463/25 |
| 8,105,149 | B2 * | 1/2012 | DeWaal | 463/20 |
| 2002/0065123 | A1 * | 5/2002 | Packes et al. | 463/16 |
| 2003/0060266 | A1 * | 3/2003 | Baerlocher | 463/20 |
| 2003/0114220 | A1 * | 6/2003 | McClintic | 463/25 |
| 2004/0204235 | A1 * | 10/2004 | Walker et al. | 463/29 |
| 2004/0242302 | A1 * | 12/2004 | Baerlocher | 463/16 |
| 2005/0026676 | A1 * | 2/2005 | Olive | 463/20 |
| 2005/0215311 | A1 * | 9/2005 | Hornik et al. | 463/20 |
| 2006/0030399 | A1 * | 2/2006 | Baerlocher | 463/20 |
| 2006/0073897 | A1 * | 4/2006 | Englman et al. | 463/42 |
| 2006/0084505 | A1 * | 4/2006 | Yoseloff et al. | 463/42 |
| 2007/0060258 | A1 * | 3/2007 | Duhamel | 463/16 |
| 2007/0135195 | A1 * | 6/2007 | Albino | 463/13 |
| 2008/0113765 | A1 * | 5/2008 | DeWaal | 463/25 |
| 2009/0111564 | A1 * | 4/2009 | Smith et al. | 463/20 |
| 2010/0203948 | A1 * | 8/2010 | Falciglia, Sr. | 463/20 |

* cited by examiner

*Primary Examiner* — Seng H Lim
(74) *Attorney, Agent, or Firm* — Michael A. Cantor

(57) ABSTRACT

A bonus game having multiple levels of play includes credit-based and jackpot awards at one or more of the levels. The jackpot awards remain at a constant value regardless of the wager made. The expected return at the jackpot award level is generally held constant despite varying wagers through the use of a feature that provides for early termination of the bonus game at one or more levels played prior to that of jackpot award level. A reduced probability of reaching the jackpot award compensates for increased wagers and maintains the expected return constant or increasing with wager.

15 Claims, 10 Drawing Sheets

1 credit per payline wager

| Jackpot Award = $10,000 | | | | |
|---|---|---|---|---|
| 100 | 200 | 300 | 400 | 0 |
| 100 | 200 | 300 | 400 | 0 |
| 100 | 200 | 300 | 400 | 0 |

2 credit per payline wager

| Jackpot Award = $10,000 | | | | |
|---|---|---|---|---|
| 200 | 400 | 600 | 800 | 0 |
| 200 | 400 | 600 | 800 | 0 |
| 200 | 400 | 600 | 800 | 0 |

3 credit per payline wager

| Jackpot Award = $10,000 | | | | |
|---|---|---|---|---|
| 300 | 600 | 900 | 1200 | 0 |
| 300 | 600 | 900 | 1200 | 0 |
| 300 | 600 | 900 | 1200 | 0 |

4 credit per payline wager

| Jackpot Award = $10,000 | | | | |
|---|---|---|---|---|
| 400 | 800 | 1200 | 1600 | 0 |
| 400 | 800 | 1200 | 1600 | 0 |
| 400 | 800 | 1200 | 1600 | 0 |

5 credit per payline wager

| Jackpot Award = $10,000 | | | | |
|---|---|---|---|---|
| 500 | 1000 | 1500 | 2000 | 0 |
| 500 | 1000 | 1500 | 2000 | 0 |
| 500 | 1000 | 1500 | 2000 | 0 |

1 credit per payline wager

| Jackpot Award = $10,000 | | | | |
|---|---|---|---|---|
| 100 + 4000 | 200 | 300 | 400 | 0 |
| terminate | terminate | terminate | 1000 | terminate |
| 100 | 200 | 300 | 400 | |

2 credit per payline wager

| Jackpot Award = $10,000 | | | | |
|---|---|---|---|---|
| 200 + 3000 | 400 | 600 | 800 | 0 |
| terminate | terminate | terminate | 2000 | 0 |
| 200 | 400 | 600 | 800 | 0 |

3 credit per payline wager

| Jackpot Award = $10,000 | | | | |
|---|---|---|---|---|
| 300 + 2000 | 600 | 900 | 1200 | 0 |
| terminate | terminate | 1800 | 1200 | 0 |
| 300 | 600 | 900 | 1200 | 0 |

4 credit per payline wager

| Jackpot Award = $10,000 | | | | |
|---|---|---|---|---|
| 400 + 1000 | 800 | 1200 | 1600 | 0 |
| terminate | 1200 | 1200 | 1600 | 0 |
| 400 | 800 | 1200 | 1600 | 0 |

5 credit per payline wager

| Jackpot Award = $10,000 | | | | |
|---|---|---|---|---|
| 500 | 1000 | 1500 | 2000 | 0 |
| 500 | 1000 | 1500 | 2000 | 0 |
| 500 | 1000 | 1500 | 2000 | 0 |

| | | |
|---|---|---|
| 1 | 2 | 3 |
| 4 | 5 | 6 |
| 7 | 8 | 9 |

Symbol Combinations from 3 x 3 Matrix

| | | |
|---|---|---|
| 1 – 2 – 3 | 4 – 2 – 3 | 7 – 2 - 3 |
| 1 – 2 – 6 | 4 – 2 – 6 | 7 – 2 – 6 |
| 1 – 2 – 9 | 4 – 2 – 9 | 7 – 2 – 9 |
| 1 – 5 – 3 | 4 – 5 – 3 | 7 – 5 – 3 |
| 1 – 5 – 6 | 4 – 5 – 6 | 7 – 5 – 6 |
| 1 – 5 – 9 | 4 – 5 – 9 | 7 – 5 – 9 |
| 1 – 8 – 3 | 4 – 8 – 3 | 7 – 8 – 3 |
| 1 – 8 – 6 | 4 – 8 – 6 | 7 – 8 – 6 |
| 1 – 8 – 9 | 4 – 8 - 9 | 7 – 8 – 9 |

FIG. 2

Probability of Advancing to Next Level of Bonus Game

| Bonus Game Level | Credit Wager per Payline | Number of Selectable Positions | Number of Termination Symbols | Probability of Advancing to Next Level |
|---|---|---|---|---|
| Level 1 | 1 - 10 | 13 | 0 | 100% |
| Level 2 | 1 - 10 | 11 | 0 | 100% |
| Level 3 | 1 - 10 | 9 | 0 | 100% |
| Level 4 | 1 - 10 | 7 | 0 | 100% |
| Level 5 | 1 | 5 | 4 | 20% |
| Level 5 | 2 | 5 | 3 | 40% |
| Level 5 | 3 or 6 | 5 | 2 | 60% |
| Level 5 | 4 or 8 | 5 | 1 | 80% |
| Level 5 | 5 or 10 | 5 | 0 | 100% |
| Level 6 | 1 - 5 | 2 | 1 | 50% |
| Level 6 | 6, 8, or 10 | 2 | 0 | 100% |

Overall Probability of Advancing to the Jackpot Award Level

| Credits/Payline | level 1 | level 2 | level 3 | level 4 | level 5 | level 6 | Overall Probability |
|---|---|---|---|---|---|---|---|
| 1 | 100% | 100% | 100% | 100% | 20% | 50% | 10% |
| 2 | 100% | 100% | 100% | 100% | 40% | 50% | 20% |
| 3 | 100% | 100% | 100% | 100% | 60% | 50% | 30% |
| 4 | 100% | 100% | 100% | 100% | 80% | 50% | 40% |
| 5 | 100% | 100% | 100% | 100% | 100% | 50% | 50% |
| 6 | 100% | 100% | 100% | 100% | 60% | 100% | 60% |
| 8 | 100% | 100% | 100% | 100% | 80% | 100% | 80% |
| 10 | 100% | 100% | 100% | 100% | 100% | 100% | 100% |

FIG. 4

1 credit per payline wager

| Jackpot Award = $10,000 | | | | |
|---|---|---|---|---|
| 100 | 200 | 300 | 400 | 0 |
| 100 | 200 | 300 | 400 | 0 |
| 100 | 200 | 300 | 400 | 0 |

2 credit per payline wager

| Jackpot Award = $10,000 | | | | |
|---|---|---|---|---|
| 200 | 400 | 600 | 800 | 0 |
| 200 | 400 | 600 | 800 | 0 |
| 200 | 400 | 600 | 800 | 0 |

3 credit per payline wager

| Jackpot Award = $10,000 | | | | |
|---|---|---|---|---|
| 300 | 600 | 900 | 1200 | 0 |
| 300 | 600 | 900 | 1200 | 0 |
| 300 | 600 | 900 | 1200 | 0 |

4 credit per payline wager

| Jackpot Award = $10,000 | | | | |
|---|---|---|---|---|
| 400 | 800 | 1200 | 1600 | 0 |
| 400 | 800 | 1200 | 1600 | 0 |
| 400 | 800 | 1200 | 1600 | 0 |

5 credit per payline wager

| Jackpot Award = $10,000 | | | | |
|---|---|---|---|---|
| 500 | 1000 | 1500 | 2000 | 0 |
| 500 | 1000 | 1500 | 2000 | 0 |
| 500 | 1000 | 1500 | 2000 | 0 |

FIG. 5a 1 credit per payline wager

| Jackpot Award = $10,000 | | | | |
|---|---|---|---|---|
| 100 + 4000 | 200 | 300 | 400 | 0 |
| terminate | terminate | terminate | 1000 | terminate |
| 100 | 200 | 300 | 400 | |

2 credit per payline wager

| Jackpot Award = $10,000 | | | | |
|---|---|---|---|---|
| 200 + 3000 | 400 | 600 | 800 | 0 |
| terminate | terminate | terminate | 2000 | 0 |
| 200 | 400 | 600 | 800 | 0 |

3 credit per payline wager

| Jackpot Award = $10,000 | | | | |
|---|---|---|---|---|
| 300 + 2000 | 600 | 900 | 1200 | 0 |
| terminate | terminate | 1800 | 1200 | 0 |
| 300 | 600 | 900 | 1200 | 0 |

4 credit per payline wager

| Jackpot Award = $10,000 | | | | |
|---|---|---|---|---|
| 400 + 1000 | 800 | 1200 | 1600 | 0 |
| terminate | 1200 | 1200 | 1600 | 0 |
| 400 | 800 | 1200 | 1600 | 0 |

5 credit per payline wager

| Jackpot Award = $10,000 | | | | |
|---|---|---|---|---|
| 500 | 1000 | 1500 | 2000 | 0 |
| 500 | 1000 | 1500 | 2000 | 0 |
| 500 | 1000 | 1500 | 2000 | 0 |

FIG. 5b

GAMING MACHINE BONUS

FIELD OF THE ART

This invention relates generally to gaming machines. In particular, the invention provides for a bonus game that offers the player a jackpot award of the same value and the same expected return at the jackpot award level regardless of the wager made.

BACKGROUND

Slot machines have been a form of entertainment to the public for many decades. They began as mechanical, three-reel devices that, through mechanical means, were made to rotate and then to separately come to a stop; each at a distinct location along the reel. The result would be a series of symbols or blanks—one per reel—that would be displayed horizontally along a payline, each symbol or blank being one in a set of symbols or blanks included on the reel strip. Each displayed symbol or blank corresponded with a distinct stopping point associated with the respective reel. The given combination of displayed symbols or blanks along the payline, which corresponded to the given sequence of stopping points, provided a specific, pre-determined result. When a wager was made to initiate this mechanical action, the predetermined result would be a winning, losing or draw situation where the player would either be compensated over and above the value of the wager made, lose his wager or receive back his wager. For instance, the combination of an orange symbol on the first reel stop, '7' symbol on the second and a blank on the third might correspond to a losing result and therefore nothing would be distributed to the player resulting in a complete loss of the player's wager. A cherry symbol in the first reel followed by any two other symbols or blanks might result in a draw whereby the player's wager would be returned but with no distribution of additional monies. A series of '7' symbols on each reel might be a winning result awarding the player with a return greater than the amount of the player's wager.

While this simple form slot machine provided entertainment, it has been the continuous goal of slot machine developers to develop slot machines, including the games that reside therein, with ever-increasing entertainment value. The higher the entertainment value of the machine, the greater its use and therefore, generally, the greater revenue yield for the house (since by mathematical design the house always retains a certain percentage of the monies wagered over time). Thus, this basic form of slot machine has evolved with great strides over the years to satisfy this goal. Some of these include:

Video Representations of Reels: The slot machines of the past have taken a new direction and are now also manufactured as electronic gaming machines. These gaming machines now display reel-like images on a video monitor and are activated through electronic input and controlled through processors that execute code-based computer instructions. The reel images once activated are displayed as spinning reels with each individually coming to a stop based on a time-dependent algorithm.

Computer-generated Symbol Images and Animations: The symbols of the reel strips are generated as computer images which generally appear within a symbol matrix when the reels are shown to stop on the gaming machine monitor. On some displays, the symbols are visible as the reel images spin. Additionally, since the gaming machine is now essentially a computer having a high-resolution monitor, animated images and visual effects can be created and displayed at the symbol locations to further enhance entertainment value.

Touch Screens: A touch screen interface is deployed on many of today's gaming machine monitors. This allows the player to interact more with the game. Among other things, the player can choose paylines, denomination, control the volume, choose when to initiate action, even determine with a degree of precision when an individual reel will stop. The interface detects the players touch on the gaming machine monitor through a change in resistance or capacitance at the location in which the monitor is touched and transfers this as spatial input data to the gaming machine processor, which processes the function intended to be affected at that location.

Theme Games: The typical "fruit" games that displayed symbols generally of various fruits, the number '7' and blank spaces matured into various themed games that used symbols associated with the theme and theme-related graphics in the glass displays of the machines to attract players. To amplify on this, certain well-known brands were licensed by the gaming machine developers; perhaps the best known being the WHEEL OF FORTUNE® brand licensed by gaming machine manufacturer and developer IGT.

Multiple Selectable Paylines: Gaming machines began by displaying results along only one payline. Now multiple paylines exist. The player need not be limited to the result indicated by the symbol combination displayed horizontally from the first reel to the last reel along one row. Now the player may select varying payline paths and therefore varying numbers of paylines. The player is generally only limited by the mathematical combinations of symbol paths aligned from the first reel to the last reel. In a symbol matrix having three by five (3×5) symbol positions, this equates to 243 different pay lines.

Virtual Stops: The symbol combinations resulting from the early slot machines were wholly dependent on the mechanics of the machine. Although it was by random chance, the reel was stopped exclusively by the mechanics of the machine. Therefore, any symbol or blank had the same mathematical probability of being displayed as the selected symbol along the payline as any other symbol or blank on that reel. Therefore, if there were 50 symbols per reel and only one of those symbols was, for instance, a '7' symbol, there would be a 1 out of 50 chance of the '7' symbol being displayed and, for a three reel slot machine each having the same 1 out of 50 chance, a 1 out of 125,000 chance of a '7' symbol being displayed on all three reels. This limited the amount of win that could be awarded to the player. If one nickel were wagered, no more than $6,250 dollars (125,000 nickels) could be awarded else the advantage to the house would be lost. Although significant, this amount—the highest that could be given for this described machine of three reels with 50 potential positions per reel—only provided so much entertainment value given that the award was not a life altering event. With the advent of random number generators, a software program that can randomly select a number from any set of numbers with each number having the same stochastic probability of being selected as the next, games could be designed whereby the selected number would provide the symbol combination result. Each number in the set of numbers would be assigned or "mapped" to a specific symbol combination. For each number selected, the game programming would map the given result to the reels and the assigned symbol combination would be displayed. Thus, in the same example as above, instead of having only a 1 in 125,000 chance of obtaining the symbol combination of three '7's along the payline, there could be any number of probabilities. If the set of numbers was one million and only one of those numbers was mapped to the triple '7' symbol combination, then there would be a one in a million chance of the random number generator selecting that number and displaying the triple '7' combination on the gaming machine monitor along the selected payline. An award in the neighborhood of $5,000,000 could then be provided—a life altering award and a game that a player would generally be more inclined to play.

Variable Denomination: Legacy slot machines accepted coins of a certain, specific denomination. Therefore, a player had little choice but to play the slot machine game by inserting a nickel, dime or quarter, as required by the particular machine. Only if the same game existed on more than one machine and those machines had differing denominations would a player have some choice in determining the wager he wished to make on a certain game. Gaming machines of today accept currency, coin and credit through varying input devices; be it a coin collector for accepting coinage, bill validator for accepting paper currency, a ticket validator for accepting monetized, secure tickets, or a smart card device that may accept debit cards, credit cards or the like. When received, the amount is recorded on the machine (and may be debited or credited against the smart card). A denomination can then be selected and the gaming machine logic records credits to the machine, which is simply the result of the monetary amount input to the machine divided by the denomination selected. With this capability the player can not only select the denomination for each game played, but for a given wager amount the player can now select a lower denomination and spread the wager out over numerous paylines. For instance, if the player wishes to wager one dollar, some of the options the player would have for making that wager would be: (i) select one dollar as the denomination and bet it on one payline, (ii) choose quarter denomination and wager on four selected paylines, (iii) choose quarter denomination and wager fifty cents for each of two selected paylines, (iv) choose penny denomination and wager ten cents for each of ten selected paylines. This type of flexibility and ability to play more pay lines generates greater excitement for the player.

Bonus Games: A variety of different bonus games, both mechanical and computer-animated, are now included with many gaming machine games. They can be triggered either randomly or through a specific triggering event from the initial or base game. Some bonus games are simply additional, free plays of the base game. Sometimes the base game may be modified in some fashion to create more interest. Other times the bonus game is entirely separate from the base game though it may be displayed either in the same monitor as the base game, a secondary monitor, or it may be a separate device associated with the gaming machine (a well know example of this would be the physical, spinning wheel used with the WHEEL OF FORTUNE® casino game developed by IGT). Sometimes the bonus game will require player interaction and sometimes it will not. For instance, the Wheel of Fortune game, whether through a physical spinning reel or a simulated reel displayed in a computer monitor, only requires that the player initiate a spin. The wheel then spins. When it stops, the award provided to the player is displayed at a given marker. Player interaction may be required in bonus games where the player selects one of a number of options and is given an award or some other result based on the selection. There are a multitude of different bonus-type games and methods. Much of today's game design is geared towards coming up with new and innovative type bonus events to further amuse and entertain the player.

Progressive Jackpots: Progressive jackpots are variable jackpot amounts that grow over time and are funded through contributions made by each player that is given a chance at winning the jackpot. The contributions are made from a portion of the wager made for play of the base game. Therefore, the jackpot continuously grows until it is won and then reset to some pre-determined lower value. These jackpots can be dedicated to a singular gaming machine but are more often associated with a bank of gaming machines that link to a computer server that controls all aspects of the jackpot through a network. These jackpots can be associated with a particular win on the base game, randomly awarded, or associated with a particular win in a bonus game. They are very attractive to players due to the fact that they can grow very large over time and because, when associated with a bank of machines, they provide a sense of enjoyed community among the players. Sometimes there games include progressive jackpot levels. These games split up the progressive jackpot awards contributing a portion of the wager to one distinct jackpot, and one or more differing portions to one or more other distinct jackpots. The jackpot awarded would vary depending on the outcome of the game, with the largest jackpot being awarded for the outcome having the least probability of occurrence.

Networks: Creating a network of gaming machines is now standard practice in most casinos and other gaming locations. The prime reasons for networking is to automate and centralize accounting for all machines on the gaming floor, to track individual players' gaming results and activities, to gain knowledge of game productivity, and to deliver games and other media from a central server to the individual gaming machines. But networks are also established among a bank of gaming machines in order to create shared bonus games and awards. Progressive jackpots are variable jackpot amounts that grow over time and are funded through contributions made by each player that receives a chance at winning the jackpot. The contributions are taken from a portion of the wager made towards play of the base game. Therefore, the jackpot continuously grows until it is won and then reset to some lower value. These jackpots can be dedicated to a singular gaming machine but are more often associated with a bank of gaming machines.

Wagering and Bonus Games: As discussed above, bonus games have become commonly used with gaming machines. They are an attractive, added part of the gaming experience. Funding of the bonus game comes from the wager made toward play of the base game. A portion of the payback percentage is attributed to the base game and a portion is attributed to the bonus game. Game developers have designed the bonus games so that the awards provided are increased in proportion to the wager made per payline or the total wager. This ensures that a constant payback percentage or expected return to the player is maintained with increasing or decreasing wager. On some bonus games, a jackpot award—typically the largest award of multiple awards available in the bonus game—may only be made available to the player if the player makes the maximum credit wager. This may change the payback percentage when the maximum credit wager is made, but it has been permitted by gaming regulators and provides incentive to the player to make the maximum credit wager. Other variations maybe provided with wager. In U.S. Pat. No. 6,186,894 by Mayeroff, the number of spins given to a player in a bonus game is dependent on the wager. That number can be determined by the number of paylines selected or the number of credits played per payline. The bonus game is triggered by a specific result in the base game. Thus, the player can be rewarded and incentivized for making an increased wager by being provided additional chances in a bonus round whence the bonus round is triggered. U.S. Pat.

No. 7,056,215 by Olive describes a random bonus triggering method. In that patent, although the bonus event is provided at random, the chances of obtaining the bonus are increased in proportion to the amount wagered. In U.S. Pat. No. 7,8268, 643 by Baerlocher, the probability of triggering a bonus is increased in proportion to the amount of paylines selected, similar to Mayeroff. However, this patent also describes varying odds at different levels of a bonus whereby the odds at each level are affected by the wager made per payline and not based on the number of paylines selected.

SUMMARY OF THE INVENTION

The present invention provides for a gaming machine having a base game and a bonus game. The bonus game is randomly triggered either upon the occurrence of an outcome in the base game or upon an event unassociated with the play of the base game (i.e. a random trigger). Generally, neither the total wager made nor the wager per payline affects the probability of triggering the bonus game although some modest changes may be applied to the trigger frequency to allow for an increase in expected return to the player with an increase in wager. When the bonus game is triggered, the probability of receiving a greater winning outcome is increased in proportion to the wager.

In a further aspect of the invention, the bonus game includes multiple levels; each level is achieved by satisfactorily completing the previously played level. Therefore, once the bonus game is triggered, the player plays an initial round at the first level. The player will then either complete the round or the round will be terminated by a random event. If the round is completed, the player will advance to the next level. If there is a third level, the second round of play will again either be completed or terminated early by a random event. If the second round is successfully completed, the player will then advance to the third round. If there are no further levels, the player completes the bonus game at the third level regardless of outcome. Each level of the bonus game generally maintains an expected return, also referred to as the payback percentage, on monies wagered. The expected return is the amount of consideration paid back to the player through winning outcomes relative to monies wagered. This is expressed as a percentage and is derived by considering the win or return to player relative to monies wagered through the averaging of multiple outcomes; the number of such sufficient to essentially remove all volatility and express the true expectation over time.

In another aspect of the invention, at least one level of the bonus game provides credit-based awards, and at least one level of the bonus game that is played after at least one credit-based award level provides a jackpot award of constant value at a given moment in time that is independent of wager. The probabilities of satisfactorily completing one or more levels of the bonus game are adjusted in relation to the wager made to ensure a constant expected return at the jackpot award level or, at least, an increasing expected return with an increase in wager. This is done by changing the odds of advancing through one or more of the credit-based award levels. The greater the wager made by the player, the greater the probability of advancing through the credit-based award levels and on to the jackpot award level of the bonus game. It is advantageous to have a jackpot award that remains constant and achievable regardless of wager made. This is attractive to players as it provides the player a chance to obtain a large jackpot award regardless of the wager made and therefore regardless if the wager is a relatively low wager.

In another aspect of the invention, although the jackpot award remains a constant value at a given moment in time, the expected return at one or more credit-based award levels may vary as long as the overall expected return of the bonus games remains constant or increases with wager. Therefore, the overall expected return of the bonus game may increase with an increase in wager while all players will still retain the ability to win the same jackpot award value irrespective of wager.

In yet another aspect of the invention, at least one of the bonus game levels, preferably the last, includes a plurality of spinning reels, each containing the same symbol indicia. The reels are spun any number of times until the same symbol is displayed from each reel along the payline. A specified award is provided for each of the number of potential outcomes that may result from the various symbols from the set of symbol indicia being displayed along the payline. The award could be associated with a progressive jackpot. The potential award remains the same for all players regardless of wager.

In another aspect of the invention, the bonus game is financed through a separate ante-bet. This provides the advantage of allowing the bonus game to be added to an existing base game without having to make any adjustments to the base game math. The math may remain the same in the base game and the bonus game will have a wholly separate mathematical model and a distinct expected return unassociated with the base game. If the ante-bet is not made in this embodiment, the bonus game will be unavailable to the player with the triggering mechanism rendered inactive.

In yet another aspect of the present invention, multiple, different gaming devices having different maximum payline selections may be simultaneously linked to a device or system that controls aspects of a jackpot award, including a progressive jackpot award that grows over time through contributions made from the player's wager or ante-bet, while providing the same probability of winning the jackpot award. This is achieved by adjusting the probability of reaching the jackpot award on either the group of gaming machines having lesser maximum payline selections than the gaming machine(s) having the greater maximum payline selections, or on the group of gaming machines having the greater maximum payline selections than the gaming machine(s) having the lesser maximum payline selections. This can also be established as between different gaming machines regardless of the maximum number of payline selections by comparing the number of selected paylines. It is an advantage to the operator of the gaming machines to provide and service only one jackpot or set of jackpots that are available to all players playing on gaming machines linked to the jackpot and not to have to distinguish jackpots as between players playing on gaming machines having different maximum payline selections or between players making different number of payline selections.

Other aspects of the invention will become apparent from the Detailed Description of the Invention.

BRIEF DESCRIPTION OF THE DRAWINGS

FIG. 2 shows a simple symbol matrix of a gaming machine's base game.

FIG. 4 is a series of tables showing the probability of advancing from level to level in a bonus game and the overall probability of reaching the jackpot award level in a bonus game.

FIG. 5*a* is a model of a simple bonus game embodiment showing how the expected return remains constant as between the multiple credit-based award levels.

FIG. 5*b* is a model of a simple bonus game embodiment showing how the expected return remains constant at each of the credit-based award levels and the jackpot award level through the use of termination symbols.

DETAILED DESCRIPTION OF THE INVENTION

In the preferred embodiment of the invention, an electronic or electro-mechanical gaming device, commonly referred to as a slot machine or gaming machine, is used to provide for casino-style game play. The gaming machine possesses at least the following basic functions: (i) the ability to receive a wager, (ii) the ability to provide a player who makes a wager with an opportunity to receive a variable outcome from the play of a game of chance, and (iii) the ability to dispense to the player consideration when the outcome from the game of chance results in a "win" (or any remainder of the wager if the outcome is a "draw" or some amount less than the wager but more then zero).

Figure 1:
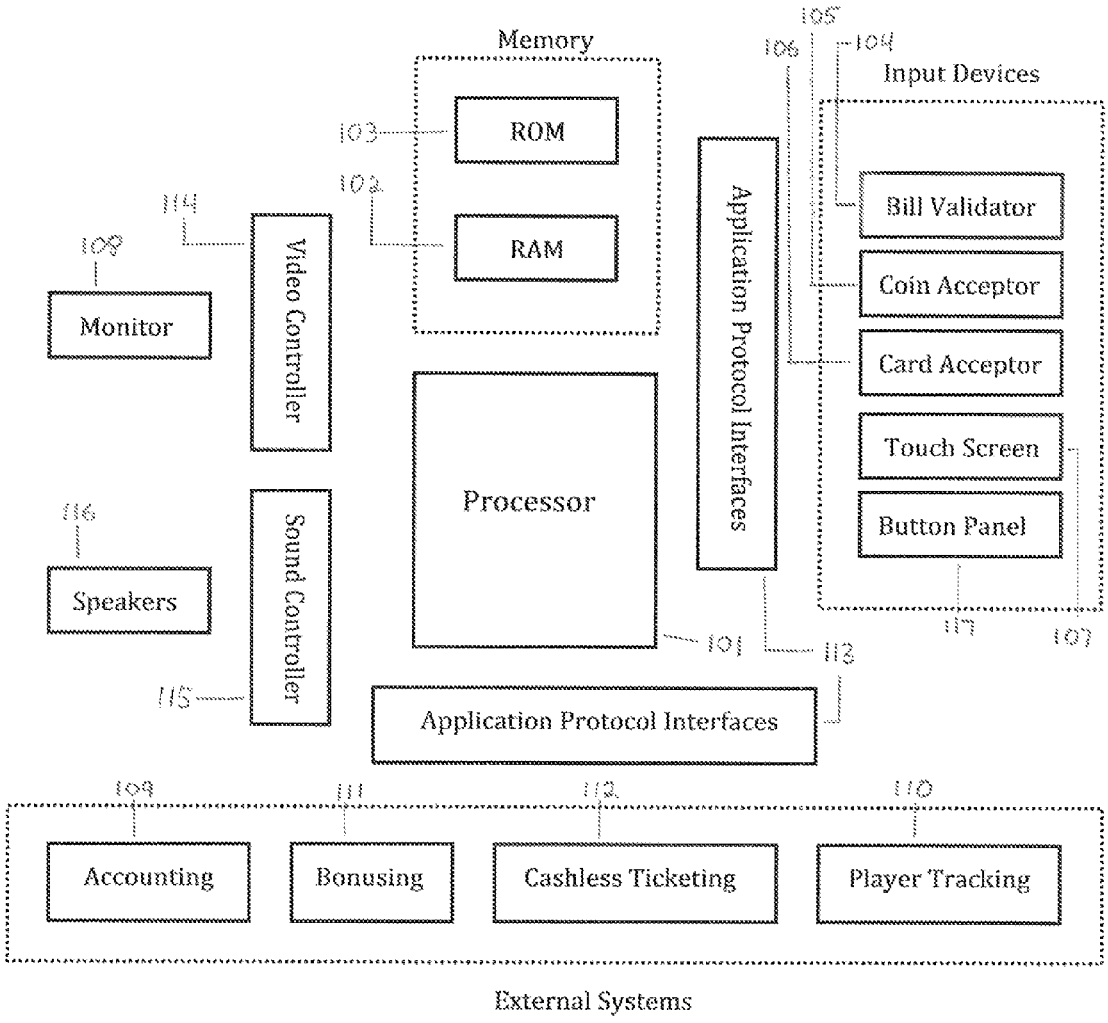
FIG. 1 is a schematic block diagram depicting the basic components of a gaming machine and typically associated devices and systems.

As shown schematically in FIG. 1, the gaming machine generally includes a processor 101 for controlling all aspects of game play and electronic memory; both random access memory 102 and static memory 103, for storing game play code. The processor is also used to interface with peripheral devices such as bill validators 104, coin acceptors 105, card acceptors 106, the touch screen interface 107 of the gaming machine monitor display 108, various network systems such as back office accounting systems 109, player tracking systems 110, bonusing systems 111, cashless ticketing systems 112 and other such systems. Separate application protocol interfaces 113 provide for communications between the gaming machine and the various devices and systems. At least one display device 108 and video display controller 114 is included on the gaming machine to display the game associated with the gaming machine and icons for inputting data through the touch screen interface 107. The processor is also used for delivering sound through a sound controller 115 to the gaming machine speakers 116. A button panel 117 and the touch screen interface 107 of the at least one display device 108 are input devices that provide information to the processor such as the desired denomination, the number of paylines to select for play, the wager per payline, the volume level and the speed of play.

Gaming machines include at least one input device for receiving legal tender. The input device may comprise one or more of the bill validator 104, coin acceptor 105, or card acceptor 106. The input device may also be used in conjunction with a cashless ticket system 112. Gaming machines receive legal tender in a variety of ways; either in the form of currency, coin, paper vouchers or tickets, credit cards, debit cards, or smart cards. The input device may receive any of the above forms of tender other than coinage by insertion of currency, voucher, credit, debit or smart card through the bezel of the input device. Coinage is received only through the coin acceptor 105. Coin acceptors are not generally used with today's gaming machines. The amount of legal tender provided or specified (in the case of a credit or debit card) is identified by the input device and transferred as credit to the gaming machine by an established application protocol interface or referred to as a communication interface between the input device and the gaming machine processor. The processor causes the gaming machine to record the total amount tendered in the gaming machine's computer memory and such amount is typically displayed at a location on the gaming machine's display monitor. Secure networks are established between gaming machines to provide for the use of any of vouchers, credit cards, debit cards or smart cards. In the case of vouchers, the secure network identifies the unique, serialized vouchers as valid legal tender having a distinct, associated value. Once inserted and after transfer of the voucher's value as credit to the gaming machine, the voucher is rendered null and void by the secure network. Networks used for receiving legal tender from credit and debit cards link to financial establishments for recording the transaction in a manner similar to other commercial transactions made using such instruments.

At the completion of game play, as initiated by action of the player, any remaining credit retained by the gaming device is generally provided to the player in the form of a new, unique, serialized voucher delivered through an output device that reflects a new monetary amount. Some gaming machines linked to systems compatible with credit cards, debit cards or smart cards may have the capability of crediting those cards with the remaining amount. Other gaming machines may provide the amount reflected by the remaining credit directly to the player in the form of currency and coin. When the legal tender provided to the player is a voucher, the voucher may be re-used at the same or other gaming machine that is linked to the same network that dispensed the voucher. Alternatively, it may be redeemed at a kiosk or other device also linked to the network. Common linkage to the same network is necessary so that the unique, serialized voucher is recognizable and the associated amount can be securely determined and thereafter nullified and voided upon redemption. The kiosk or other device then dispenses currency and/or coin to the player in the same amount as that indicated by the voucher.

The gaming machine includes the capacity to wager in at least one denomination (e.g. penny, nickel, quarter). The gaming machine of the preferred embodiment allows the player to select from a plurality of varying denominations. The player selects the denomination from one of the buttons on a button panel or by providing input via a touch screen interface on the gaming machine monitor. Information on which denomination is selected is communicated to the processor and the gaming machine logic converts the amount of legal tender transferred to the gaming machine through the input device into a number of credits. For example, if $10.00 is transferred to the gaining machine and nickel denomination is selected, the gaming machine will be given 200 credits (20 credits per $1.00).

The gaming machine of the present invention includes a base game and at least one bonus game. The base game is displayed in the gaming machine monitor. The bonus game is also displayed in the gaming machine monitor, but alternatively may be displayed in the top box display monitor. The player selects a number of paylines in the base game. At least one credit is wagered for each payline selected. The wager made for each game play comprises two separate features; the number of paylines and the wager per payline. These features together dictate the total wager. If five paylines are selected at least five credits are wagered. The number of credits per payline may be increased by selecting additional credits per payline using buttons of the button panel or through interface with touch screen interface. For instance, if three credits per payline are wagered, the total wager would be for 15 credits. If nickel denomination is selected, the total wager would be 75 cents. Game play outcomes are assessed only along the selected paylines. FIG. 2 shows a simple base game having three rows and three columns making up nine matrix or symbol positions. The symbols and symbol matrix positions are depicted by the numbers 1 through 9. The number of possible paylines for such a game would be 27 ($3^3$). All of the symbol combinations representing the 27 paylines are shown below the matrix. The base game can include any number of rows and columns of symbols; including a three row 4 column matrix having 81 ($3^4$) possible paylines; a three row five column matrix having 243 ($3^5$) possible paylines; or any other developed combination.

After the input of legal tender, the selection of denomination (which provides credit to the gaming machine), the number of paylines are selected, and the credit wager per payline is made, the base game is available for play. Base game play is then initiated by action of the player. The player may initiate action by pressing a designated button on the button panel or by touching a location on the touch screen monitor interface, both of which then generate an input signal to the gaming machine processor signaling the processor to initiate game play.

Bonus game play is randomly triggered. In one embodiment of the invention, the bonus game is triggered in a manner unassociated with the base game outcome. In another embodiment of the invention, the bonus game is triggered in association with the base game outcome. Therefore, in the former embodiment, the bonus game will be triggered by a random number generator but the result provided by the random number generator will have no bearing on the base game outcome. The random number generator result for the base game outcome will therefore be independently established and wholly unassociated. The player will thus trigger the bonus game regardless of symbol combinations generated along any active payline. Since the mathematical necessities of gaming machines require that game outcomes most often result in a loss to the player, the bonus game will most often be triggered when the player has an unsuccessful, losing outcome during base game play. The player may nonetheless by chance trigger the bonus game during the same time as a winning game play outcome albeit the triggers for each are wholly independent. This embodiment provides the player with the true appearance that the bonus can be triggered during any game play, regardless of result, and therefore provide an impression that there are two separate, unassociated ways of winning at the gaming machine; either through the random bonus or through outcome of the base game. In the latter embodiment, the player receives the true impression that the base game outcome and the bonus game trigger are related and one cannot occur without the other. Therefore, one or more specific symbol combinations, which are mapped to one or more specific random number generator outcomes, must occur along an active payline in order for the bonus game to be triggered. Although both embodiments can be programmed to include the same probability for triggering the bonus game, one embodiment may appeal to a certain player over the other embodiment. In a third embodiment, both methods for triggering the bonus game may be used. Therefore, a trigger could occur based on the base game outcome or via an unassociated, independent result from the random number generator. If both types of triggers were included, the mathematical probabilities of the game would be adjusted accordingly to ensure that the probability of triggering the bonus game remained within the criteria required to ensure a specified expected return. Unless the bonus game is fully funded through the wager of an ante bet (see below), the expected return from the bonus game will be controlled in part by the number of times the bonus game is triggered per amount wagered through the base game. A gaming machine having a 90 percent payback percentage would statistically provide 90 cents back to the players playing the gaming machine for every dollar wagered. If 10 percent of that 90 percent overall payback was attributed to the bonus game, then 80 percent would be paid back through winning outcomes on the base game and 10 percent through the bonus game. The random number generator would be programmed in the first embodiment to ensure that based on the frequency of triggering and the average amount of win per bonus game once triggered, statistically 10 percent of that received as wagers would be returned to the player through the bonus game. In the second embodiment, winning outcomes in the base game that also triggered the bonus game would account for 10 percent of the payback plus the percentage payback attributed to those base game outcomes, as determined by the game programming as defined by the game's paytable (i.e. the mathematical probabilities of obtaining the variety of possible symbol combination outcomes). The remainder of the overall payback percentage of 90 percent would be attributed to those base game outcomes that do not trigger the bonus game. With the third embodiment, the 10 percent payback percentage apportioned to the bonus game is further apportioned; assigning, for instance, a statistical five percent to the random trigger unassociated with base game outcome and five percent to the trigger that is associated with the base game outcome. Thus, a trigger would exist for entering the bonus game upon a wholly independent random number generator result and an additional trigger would exist upon one or more distinct random number generator results associated with the base game outcome and therefore a specifically mapped symbol combination along a payline.

As described above, the bonus game is triggered either through a random number generator outcome independent of or associated with the random number generator outcome of the base game. In the present invention, the probability of triggering the bonus game remains constant regardless of wager made per payline or the number of paylines selected. Alternatively, the probability of triggering the bonus could be modified to provide for an increase in the expected return with an increase in wager to incentivize the player to make a larger wager or and to simply help provide a mathematically desired expected return (a detailed discussion of how the expected return is to remain constant or increasing with wager within a reasonable range is discussed below). The amount of credits wagered per payline (i.e. not the number of paylines) affects only the value of the bonus game but not the probability of its trigger. (Note: references to "wager" in the bonus game, if not specified, should be understood to mean wager or credit applied per payline). Regardless of whether the expected return remains constant with wager or increases with wager, the player is incentivized to make a larger wager so that the player will have a greater probability and more easily advance through the credit-based award levels and to the jackpot award level. The expected return may remain the same, but the player that desires to reach the jackpot award level in the bonus game will nonetheless wish to make the larger wager to have the better chance of getting there.

In the present invention, the bonus game includes multiple different bonus game levels; each level having a separate and distinct outcome and expected return, and requiring a satisfactory outcome, as defined by the particular game played at the respective level, to initiate and play the next level of the bonus. The expected return at each level is a fraction of the payback percentage of the overall bonus game. The present invention provides credit-based awards at one or more levels of the bonus game that increase with wager and a jackpot award at one or more levels of the bonus game that remain constant at any given moment in time irrespective of wager. This does not infer that the jackpot award does not increase over time; as it may if such is a progressive jackpot, only that any player making any wager of any amount, once reaching the jackpot award level and playing for the jackpot, will have the same chance to win that jackpot of a given amount at the particular moment in time that the player plays to win the jackpot award. In order to maintain a constant payback percentage regardless of wager, while also providing the player with the ability to win the jackpot award that remains of the same value, the probability of obtaining a successful outcome at one or more levels of the credit-based award levels is adjusted. The adjustment serves to proportionally offset the variation in wager and retain the same expected return for each level of the bonus game and for the bonus game as a whole. Alternatively, the expected return may increase with an increase in wager at any or all of the credit-based award levels thereby increasing the expected return of the bonus game as a whole. Additionally, adjustments to the bonus game triggering frequency may be made dependent on wager to ensure the expected return remains constant or increases with wager. Regardless of whether the expected return remains constant with wager or increases with wager, the player is incentivized to make a larger wager so that the player will have a greater probability and more easily advance through the credit-based award levels and to the jackpot award level. The expected return may remain the same (or modestly increase with wager), but the player that desires to reach the jackpot award level in the bonus game will nonetheless make the larger wager to have a better chance of getting there since, for many players, this is the one of the most gratifying results to be gained from the game.

Figure 3A:
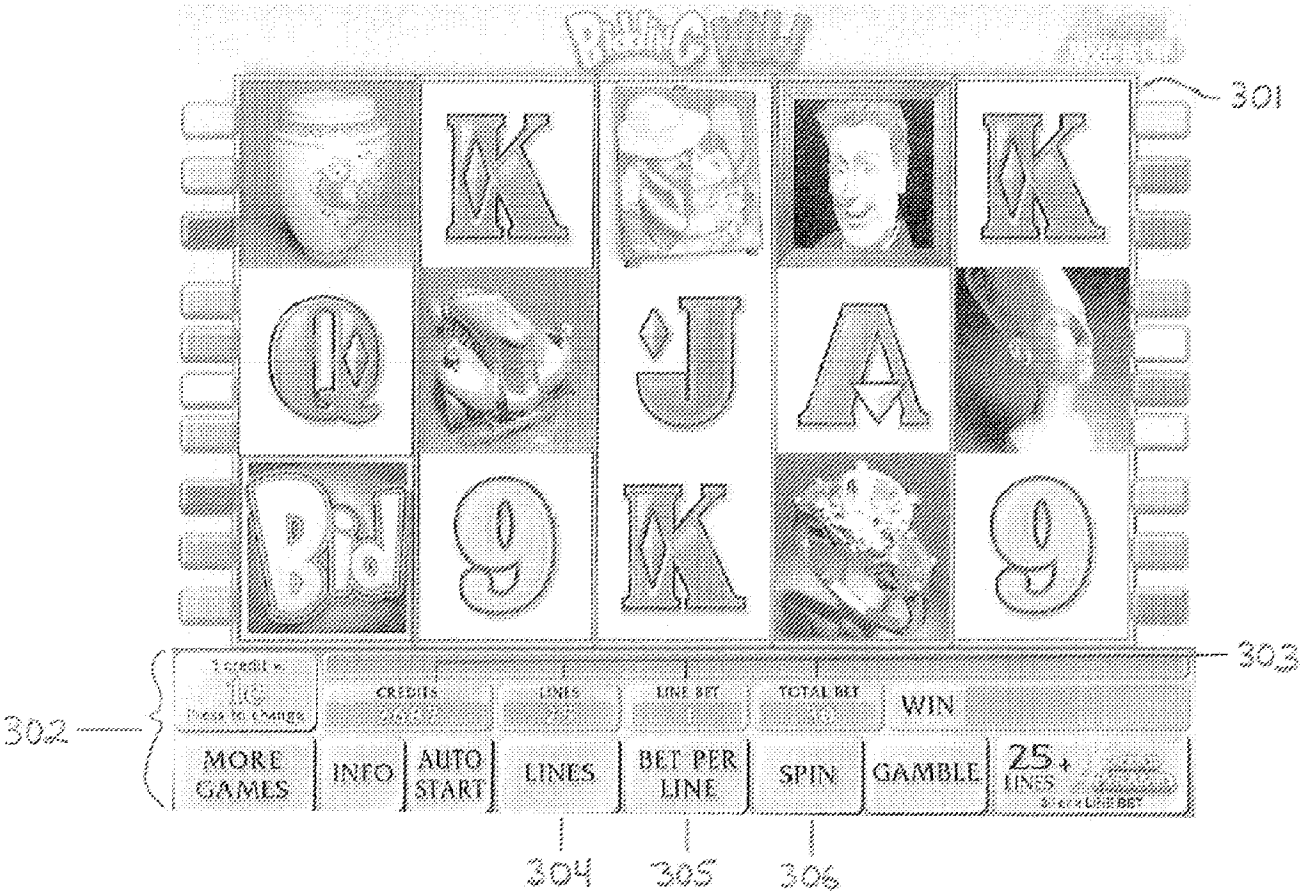
FIG. 3A depicts a sample base game of a gaming machine that may be used with the present invention.

Referring to FIG. 3A, a base game display is shown having a three by five matrix 301 of rows and columns providing 243 possible paylines. The location of the touch screen interface 302 is displayed along with various display windows 303 to provide the player with indicia of the game. The number of lines is selected by touching the location of the monitor screen that displays "LINES" 304. The wager per payline is determined by touching the location of the monitor screen that displays "BET PER LINE" 305. Game play is initiated by touching the location on the touch screen monitor that displays "SPIN" 306. Various other touch-specific locations are included for a variety of other functions. All functions provided on the touch screen monitor may also be initiated through use of the button panel (not shown in this figure).

The present invention allows the addition of the bonus game to any existing base game as a separate, add-on module. Modifications to the mathematics and game play of the base game are not required. The average expected return of the base game and bonus game are distinct and unrelated. The expected return of the base game is funded through the wager per payline and the average expected return of the bonus game is funded through a separate, optional ante-bet wager. Thus, minimal integration and programming are required to include the bonus game. When the bonus game is added as a separate module, all such integration and programming is directed towards triggering the bonus through the random number generator outcome. Additional programming is necessary to ensure that the bonus game receives input information as to the credits wagered per payline, to accommodate accounting, and to accommodate other functions peripheral to the actual game play and expected return of the base game. However, changes directly associated with the base game and the base game's mathematics and the mapping of random number generator outcomes to symbol combinations are not required. As stated above, the bonus game module supports its distinct expected return through the ante-bet—a separate and independent wager 308. The player that makes the ante bet receives a chance at triggering the bonus game. The ante-bet increases with the wagered credits per payline. Separate funding of the bonus game through the ante-bet allows the gaming machine's overall expected return with the inclusion of the bonus game to maintain the approximate expected return of the base game. For instance, if the expected return of the base game is 90 percent and accounts for 75 percent of the gaming machine's overall payback, and the expected return of the bonus game is 80 percent and accounts for the remaining 25 percent of the gaming machine's overall payback, then the aggregate expected return for the gaming machine when the ante-bet is made would be 87.5 percent ((0.75×0.9)+(0.25×0.8)). However, if the bonus game is funded through contributions from the base game wager and not the ante-bet, then the payback from the bonus game would be purely additive resulting in a 20 percent increase in the gaming machine's overall payback percentage or 110 percent ((0.9+(0.25×0.8)). This is a substantial variation from the expected return designed into the base game and would deter a game designer from adding the bonus game if it would affect the gaming machine payback to this degree. In this particular example, it would completely prevent use of the bonus game since the overall expected return through addition of the bonus game causes an expected return to the player that is greater than the average wager made. A gaming machine cannot operate in this manner since the provider of gaming machines must retain some portion of the wager as profit so that the provider may finance his business operation. A gaming machine that pays back to the players more than it receives from the players cannot be sustained. For these reasons, the present invention provides for self-funding of the bonus game through the ante bet wager allowing it to be added as a module to any existing game with limited integration and limited affect on expected return. Alternatively, an ante-bet need not be included. The bonus game can be included with the base game not as an add-on module but as an integrated module. The mathematics of the base game would need to be modified in this embodiment to accommodate the added return provided from the bonus game but could be modified such that the overall expected return of the gaming machine remains within design parameters and not a percentage that would be untenable to the operator's business.

Figure 3B:
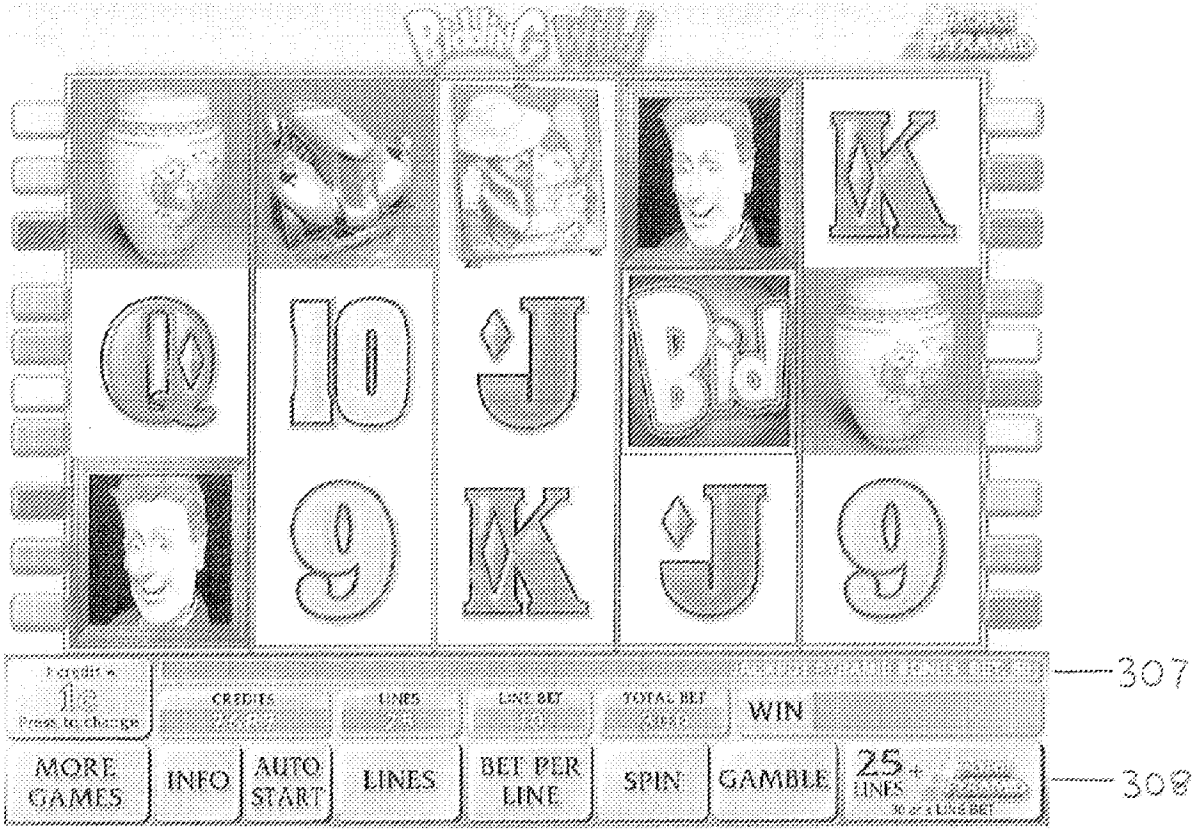
FIG. 3B depicts the optional selection of an ante-bet.

As shown in FIG. 3B, the ante-bet wager 307 is optionally made by player selection 308 to receive an opportunity to trigger the bonus game. The ante-bet in this embodiment is equal to one credit for each five selected paylines. Twenty-five paylines are selected with a wager of 10 credits per payline. The total wager made for play of the base game is 250 credits (10 credits multiplied by 25 lines). The ante bet made to receive a chance at triggering the bonus game is 50 (a 5 credit ante-bet for 25 lines played multiplied by 10 credits per payline). The total wager made for base game play and for the chance to trigger the bonus is 300.

Figure 3C:
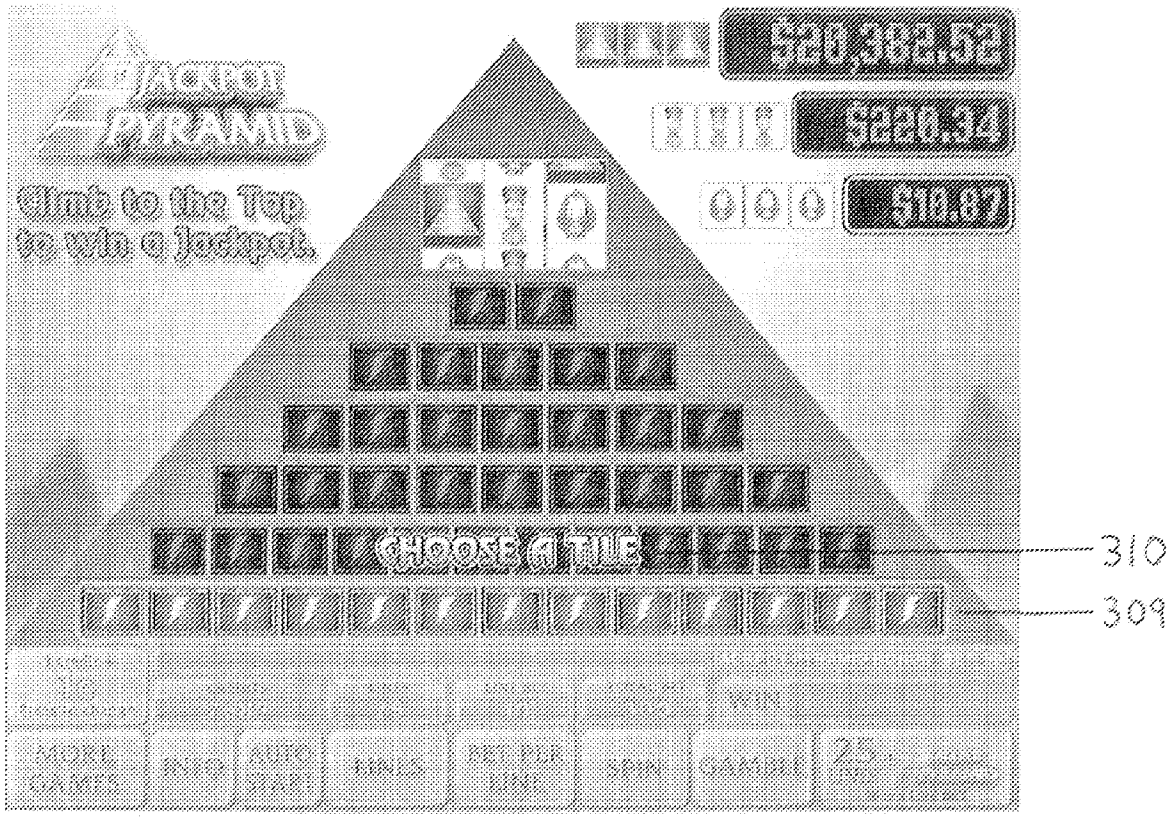
FIG. 3C shows a bonus game used in the present invention having selectable tiles.

A bonus game that includes features of the present invention is shown in FIG. 3C. This bonus game has seven levels. The first level 309 displays a series of separate tiles 309. Each tile is separately selectable by the player. The player is prompted to select a tile 310. The player then selects one tile.

Figure 3D:
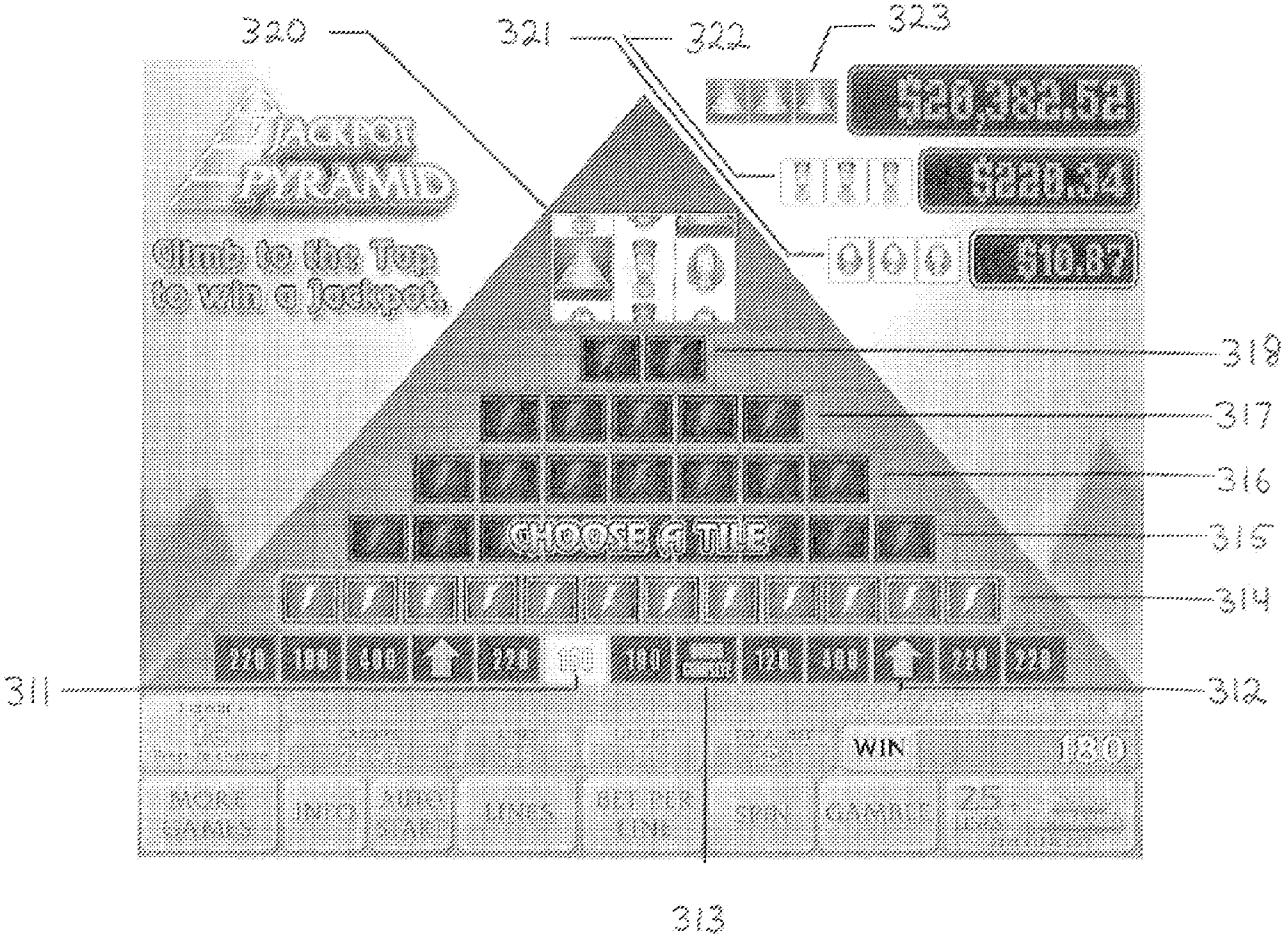
FIG. 3D shows the bonus game after the outcome at the first level.

As shown in FIG. 3D, a result 311 is then displayed. The result can be an award of some amount. In FIG. 3D, the player was awarded 180 credits as indicated by the display of "180" once the selected tile is revealed. The player could also have selected a pass through symbol 312, indicated by the "up arrow", which moves the player to the next level of the bonus game without providing the player an award of credits. The player could also have selected a termination symbol 313 displayed as "BONUS COMPLETE", which would terminate the bonus game at that point. Unless the player selects a termination symbol, the player would move to the next level in the bonus game. In this bonus game, the next level would again be a series of selectable tiles. The process continues through each of the remaining five levels 313-318 unless and until a termination symbol 313 is selected. If no termination symbol 313 is selected, the player will continue to move up in level. If an award is selected at a specific level, credits are accumulated and added to the total number of credits won to that point in the bonus game. The total credits won are displayed on the gaming machine monitor 319. If a termination symbol is selected after credits have been accumulated, the player will be provided the amount of credits won up to the point of termination. This bonus game includes a last level that is a spinning three reel display 320. This level is achieved if the player received a satisfactory outcome at each subsequent level and therefore did not select any termination symbols at any level and advanced through each level to get to the last level—the jackpot award level. The three reel display contains symbol sets for each reel. The symbol sets consist of three different symbols with each symbol appearing at least once on each reel. Therefore, each of the three reels contain the same three different symbols and each reel similarly includes each symbol at least once within its symbol set. Although this bonus game includes three reels, three symbol sets, and three different symbols, it is contemplated that various embodiments could exist having varying numbers of reels and symbol sets, and various numbers of symbols within each set. The symbols from each of the three symbol sets for this bonus game are shown at 321-323. The reels are spun repeatedly until, as shown in FIG. 4E, the same symbol aligns along the main display line for each of the three reels 324. It is also contemplated that the reels may be spun only a set number of times and that if the symbols do not align, no jackpot award is provided. Each symbol represents an award of varying amount. The awards for each symbol type are shown at 325-327. Once a series of the same symbols are aligned along the display for each of the three reels, the player is awarded the jackpot award corresponding to the displayed symbols. The awards provided at this seventh and final level of this bonus game are progressive jackpot awards that increase through contributions taken from the player's base game wager or through an ante-bet wager but are the same value for all players at any given moment in time irrespective of the base game wager or ante-bet wager made. Thus, all players reaching this level of the bonus game, regardless of the wager they made, have the same probability of winning the same jackpot award values. Although this bonus game provides the potential to win a progressive jackpot, the present invention only requires that the same award be made available to all players at a given moment in time, regardless of their wager, and that the player receives the same probability of winning the award once arriving at the respective bonus game level that provides it. It is emphasized that although the aforementioned bonus game has certain novel features, it is only one of many bonus game types that could embody the present invention. Any bonus game comprising multiple levels, each having distinct outcomes, with at least one level having credit-based awards and at least one subsequent level having a jackpot award could be utilized under the present invention.

Figure 3E:
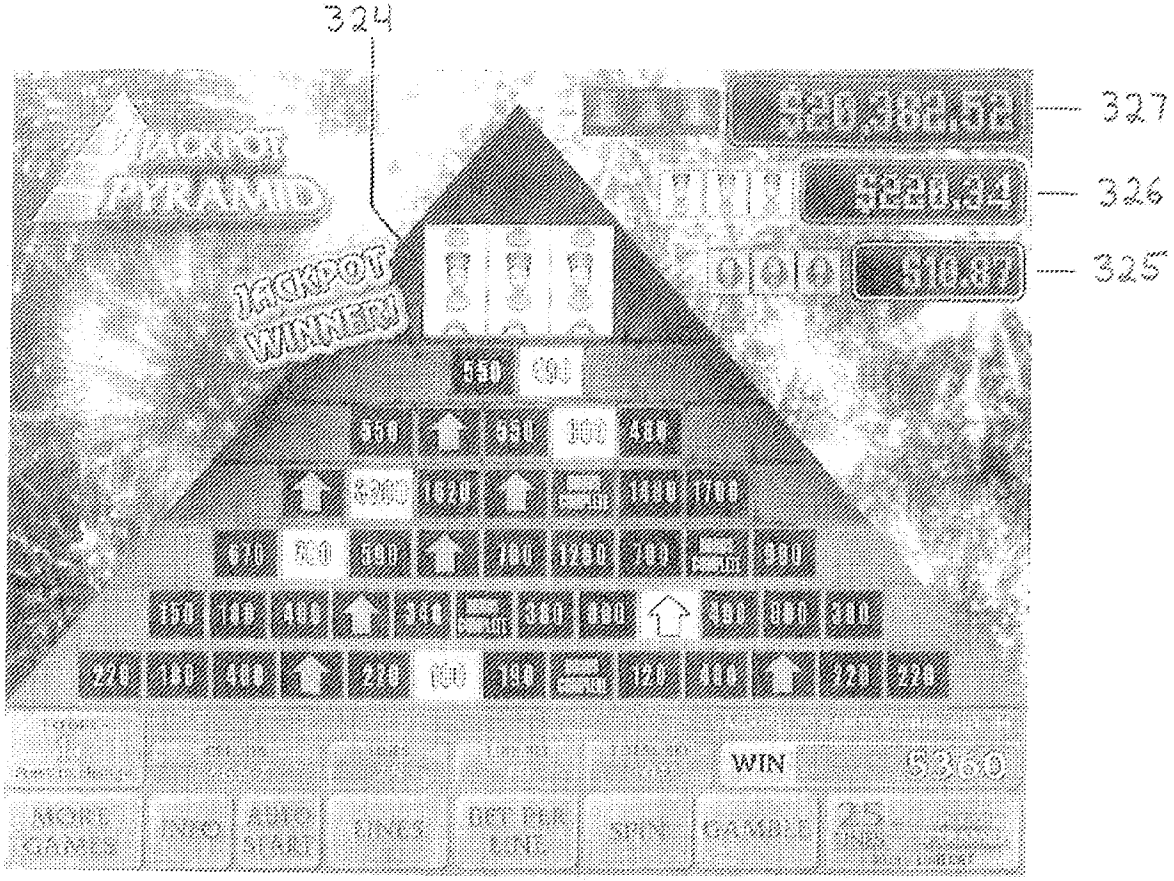
FIG. 3E shows the jackpot award level of the bonus game upon a winning outcome.

Each level of this bonus game is assigned a certain expected return, the sum of all being the expected return of the bonus game as whole. To compensate for variable wagers while ensuring that the overall expected return of the bonus game remains constant, or increases with wager, the present invention inserts termination symbols into the bonus game in a combination of mathematically required quantities and at mathematically required levels. To achieve this in bonus game similar to the illustrated bonus game of FIG. 3, the number of terminating symbols (indicated as "Bonus Complete") in each of the first four levels would be 'zero' regardless of the wager made (notwithstanding that FIG. 3 does show, for purposes of example, only, termination symbols in the first four levels). The numbers of terminating symbols in the fifth and sixth levels, only, are derived to vary in quantity and level in accordance with the number of credits wagered per payline. As shown in FIG. 3C-3E, there are five selectable tiles at the fifth level of the bonus game. For a wager of one credit per payline, the bonus game programming establishes four termination symbols (not shown in FIG. 3); providing a four in five or 80 percent probability of selecting a termination symbol 313 and ending the bonus game. At the sixth level of the bonus game, there are two selectable tiles. The bonus game programming establishes one termination symbol (not shown in the FIG. 3) at this level for the player wagering one credit per payline and therefore provides that player with a one in two or 50 percent chance of selecting a termination symbol 313 and concluding bonus game play. Combined with the 80 percent chance of termination at the fifth level, the player has a 10 percent chance of advancing to the seventh and final level of the bonus game. Similarly, the bonus game is programmed to provide a player making a two-credit wager per payline with a 40 percent probability of advancing to the sixth level 318 by including three termination symbols on the fifth level 317. The player making the two-credit wager is then given a 50 percent chance of selecting a termination symbol at the sixth level. Thus, the player making the two-credit wager per payline has a 20 percent combined chance of obtaining a satisfactory outcome through both the fifth and sixth levels and advancing to the seventh level—the jackpot award level of the bonus game. A player making a three-credit or six-credit wager receives a 60 percent probability of advancing from the fifth to the sixth level with the player making the three-credit wager having to also survive a 50 percent probability at the sixth level of advancing to the seventh level. Thus, the three-credit wager receives a combined 30 percent chance of advancing from the fifth level to the seventh level and the player making a six-credit wager receives a 60 percent chance since that player is assured of making it through the sixth level if they survive the fifth level. An 80 percent probability will exist at the fifth level for the player making a four or eight credit wager and a 100 percent probability will exist for the player making a five or ten-credit wager. The player making the four-credit or five-credit wager will have a 50 percent chance of surviving the sixth level of the bonus game but the player making the eight or ten-credit wager will be certain to advance from the sixth level since no termination symbols will be included at that level for an eight or ten-credit wager. Therefore, the player making a four-credit wager will have a 40 percent combined chance of advancing from the fifth to the seventh level, and the players making a five-credit, eight-credit and 10-credit wager will have a 50 percent, 80 percent and 100 percent combined chance, respectively, of obtaining a satisfactory outcome at the fifth and sixth levels to advance to the seventh level. In this particular embodiment, a combination of termination symbols is not provided that allows the player to make a seven-credit or nine-credit wager and maintain a constant or moderately rising expected return. Therefore, if a seven-credit wager is made, the bonus game logic provides the same probabilities of advancing in the bonus game as that provided for a six-credit wager; but only 50 percent of the time a seven-credit wager is made; and the same probabilities of advancing in the bonus game as provided by an eight-credit wager for the other 50 percent. Similarly, when a nine-credit wager is made, the bonus game logic provides the same probabilities of advancing in the bonus game as that provided for in eight-credit wager; but only 50 percent of the time a nine-credit wager is made; and the same probabilities of advancing in the bonus game as provided by a ten-credit wager the other 50 percent. This puts the probability of advancing for a seven-credit and nine-credit wager in between that of a six and eight-credit wager (i.e. 70 percent) and that of an eight and ten-credit wager (i.e. 90 percent), respectively. Note also that the combined percentage probabilities noted above for advancing from the fifth to the seventh level of the bonus game are the same as advancing from the first level to the seventh level. This is due to the fact that termination symbols are not used in levels one through four in this particular bonus game embodiment and therefore the player will always advance through these levels, regardless of wager. FIG. 4 shows the probabilities described above in a table format. For levels 1-4, there are no termination symbols. At level five, when the bet per pay line is 1, the number of termination symbols is four, the number of selectable tiles is five, and therefore the chance of not selecting a termination symbol is 20 percent. For a bet per payline of two, the number of termination symbols is three, the number of selectable tiles remains the same—five—since this is the same level of the bonus game, and the chance that the player will not select the termination symbol and will advance to the next level is 40 percent. As can be seen at FIG. 4, this increases for a bet per payline of three and six, to two termination symbols and a 60 percent chance; for a bet per payline of four and eight, to one termination symbol and an 80 percent chance; and for a bet per payline of five and ten to having no termination symbols and having a 100 percent chance of advancing to the next level. At level six of the bonus game there are two selectable tiles 318. If a bet per payline is any of one through five, there will be one termination symbol and a 50 percent chance of moving on to the seventh level. If the bet per payline is any of six through ten, then there will be no termination symbols and the player will have a 100 percent chance of passing through to the seventh level of the bonus game. As was described above, the percentage chance of advancing at levels five and six are combined to provide the overall chance of advancing through to the seventh level. This is seen in the second table of FIG. 4 where a 100% chance of advancing to the next level exists at each of levels one through four, regardless of wager, but varies at levels five and six. The combined probabilities at these last two levels provide the overall probability of advancing to the jackpot award level. Although the bonus game described includes a plurality of levels having a plurality of selectable positions that uncover termination symbols and credit awards, any form of bonus game that includes a plurality of levels with at least some having outcomes resulting in a terminating event or a credit-based award, and at least one of those levels preceding jackpot award would suffice.

Other adjustments in addition to the use of termination symbols or in lieu of termination symbols may be made to ensure a constant expected return regardless of wager or a modestly increasing expected return with wager when one or more awards of constant (including progressive) value are provided. The bonus games described in the above embodiment comprises various levels with each level consisting of a series of selectable positions, each position holding the potential of a credit-based award, a pass-through to the next level of the bonus, and/or a termination symbol. By increasing or decreasing the number of selectable positions, the payback percentage at that level is affected. Additionally, increasing or decreasing the value of the credit-based awards provided at each selectable position (including providing no value and just a pass through) will modify the payback percentage at that level. Combinations of selectable positions and value changes can together provide subtle or substantial modifications to the payback percentage at that level and therefore compensate for wager variations. The affect on probabilities for subsequent levels must also be considered. Therefore, if for a given wager no termination symbols exist at a given level of the bonus game, then there will be no affect on payback percentages to subsequent levels. But when a termination symbol is included, all subsequent levels are affected. This is due to the fact that there is a lesser probability of reaching subsequent levels. For example, if there are ten selectable positions at a given level with one of the positions having a termination symbol, the chance of moving to the next level is nine out of ten or 90 percent. If the expected return at each subsequent level were normally 10 percent of the overall bonus expected return, since they now have only a 90 percent chance of being reached, the expected return would decrease by one percent to nine percent. Similar changes would occur to the expected return in subsequent levels if the number of selectable positions at a given level were increased or decreased. So, a variety of factors can affect the expected return at each of the different levels of the bonus game and one factor at one particular level can have an effect on the payback percentages on subsequent levels. Adjustments can be made at subsequent levels, as will be seen below, to compensate for the decrease in expected return. Additionally, as stated above, the frequency of triggering the bonus in relation to the wager made can be altered to further provide an effect on expected return with wager.

As noted, the present invention maintains a constant expected return in the bonus game regardless of wager. The constant expected return is achieved through the use of termination symbols at one or more levels of the bonus game. The numbers and locations of termination symbols vary in relation to the wager. Therefore, the expected return to the player is maintained despite the fact that players making different wagers will have the same probability of receiving the given jackpot award, and in the same amount, once reaching the jackpot level of the bonus game. A unique combination of termination symbol quantities and locations is established for each wager to provide a specific probability of reaching subsequent credit-based award levels, if any, and the jackpot level. This compensates for the variation in wager and provides for a constant expected return. When a termination symbol is established at a level preceding a credit-based award level, the total available award value (which is the total credit value that could be won at that level if all tiles having credit awards could be selected) is increased so that the expected return remains the same. The termination symbol lowers the average expected return at the next level since the probability of receiving an award is lessened, but the addition of credits at the level compensates for the decreased probability. This design maintains the expected return as a constant while allowing any player making any wager a chance to win the jackpot award. Although a constant expected return is disclosed, above, the present invention nonetheless may include an expected return that increases with an increase in wager. Many gaming authorities allow for an increase in the expected return with an increase in wager and the bonus game may therefore be designed to include such. This type of design provides incentive to the player to wager more credits per payline in order to receive the higher expected return. Therefore, although it is stated that when a termination symbol is established at a level preceding a credit-based award level that the total number of credits available at the subsequent credit-based award level(s) are increased to compensate for the decreased expected return that would otherwise result, the increased credit amounts need not be increased or need not be increased in an amount that fully compensates for the decreased expected return since this result would serve to maintain a lower expected return at those levels when the wager is less in relation to the expected return when wagers are higher. This can be better understood by realizing that the greater the affect the termination symbols have on reducing the expected return in subsequent bonus game levels, which generally but not necessarily means the greater number of termination symbols used in the bonus game, the lower the wager made by the player that initiated that particular bonus game. A bonus game initiated with maximum wager would use the minimum number of termination symbols, if indeed any were used at all in that bonus game, and therefore have the least effect on expected return. A bonus game initiated with a minimum wager would make the most use of termination symbols and have the greatest effect on expected return. Irrespective of credit level increases at various levels to compensate for a decrease in expected return due to prior level termination symbols, the total available award value can be increased with an increase in wager at any level simply for the purpose of increasing expected return for the player with an increased wager.

To further illustrate aspects of the present invention, refer to FIG. 5*a*. In this simple embodiment, the bonus game consists of four levels with the first three levels being credit-based award levels and the last level being a jackpot award of constant value. At the credit-based award levels, there are five possible selections to choose from. The player makes one selection at each of the three levels. A set credit number award, including a null value, is provided at each of the five possible selections and for each of the three credit-based award levels. The expected return at each of these three levels is the same, regardless of wager. This is noted by the fact that at one credit wagered, the total number of credits available for return to the player is 1000 at each of the three levels. At two credits per payline wager, the total number of credits available for return to the player is 2000 at each of the three levels. This increases to 5000 credits available at each of the three levels when five credits per payline are wagered. For this embodiment, there is a 5-credit max wager per payline. It should be emphasized that various embodiments allow for the expected returns to vary at the respective levels and the credit-based awards to be of varying amounts from level to level and therefore not substantially consistent from level to level as displayed in FIG. 5*a*. However, in all embodiments the overall expected return of all credit-based award levels and for the overall bonus game remains the same irrespective of wager or increases with an increased wager. For the sake of simplicity, this embodiment will be discussed only in terms of a constant expected return at each of the credit-based award levels and for the bonus game as a whole.

To maintain the same expected return regardless of wager made, expected return at each level is designed to remain the same with any increase in wager per payline. As noted above, when one credit is wagered each of the three levels in this embodiment provide a total available award value of 1000 possible credits. When the wager is doubled (i.e. increased to a two-credit wager) the total available award value at each level is also doubled. This results in a possible return to the player of 2000 credits. The ratio remains consistent as between a one-credit wager—1:1000—and a two-credit wager—2:2000—and therefore the expected return for the first three levels of this bonus game remains the same since a ratio of 1:1000 is equivalent to 2:2000. For a three-credit wager, the ratio is 3:3000. For a four-credit wager, the ratio is 4:4000. And last for this embodiment, for a five-credit wager the ratio is 5:5000. All ratios are equivalent and therefore the same expected return is maintained regardless of the number of credits wagered. If one credit is wagered, one can expect an expected return that is based on a total available award value of 1000 credits. If two credits are wagered, the player can expect the same expected return since, although 2000 credits is the total available award value—twice the amount as provided for the one-credit wager—twice the amount of wager is required to receive the availability of 2000 credits. The same reasoning applies for three, four and five credit wagers. For each credit wagered, there is an expected return to the player based on the availability of 1000 credits. It is inconsequential that the credits are spread out over all or some of the possible selections. The expected return is calculated according to the following formula:

(((position 1 credits)+(position 2 credits)+(position 3 credits)+(position 4 credits)+(position 5 credits)/((credits wagered)*(no. of selectable positions)))*(trigger frequency)

For a five-credit wager in the FIG. 5*a* example, this provides the following average expected return at each of the credit-based award levels:

$$((500+1000+1500+2000+0)/(5*5))*f=200f$$

where f is the constant equal to the trigger frequency. The trigger frequency is the set probability for entering the bonus game. (Note again that this frequency can be adjusted under the present invention to provide for an increase expected return with an increase in wager, but for simplicity, it is being discussed as a constant to maintain the same expected return).

For a four-credit wager in the FIG. 5*a* example, this provides the following average expected return at each of the credit-based award levels:

$$(400+800+1200+1600+0)/(4*5)*f=200f$$

For a three-credit wager in the FIG. 5*a* example, this provides the following average expected return at each of the credit-based award levels:

$$(300+600+900+1200+0)/(3*5)*f=200f$$

For a two-credit wager in the FIG. 5*a* example, this provides the following average expected return at each of the credit-based award levels:

$$(200+400+600+800+0)/(2*5)*f=200f$$

For a one-credit wager in the FIG. 5*a* example, this provides the following average expected return at each of the credit-based award levels:

$$(100+200+300+500+0)/(1*5)*f=200f$$

But simply maintaining the expected return at each of the credit-based award levels is insufficient to ensure a constant expected return in the bonus game. The expected return at the jackpot award level must also remain constant. But absent use of termination symbols or other features that cause the probability of reaching the jackpot award level to change, the jackpot award cannot remain constant if the wager varies and the jackpot award value remains the same. Therefore, termination symbols are included relative to the credit per payline wager to adjust the probability of reaching the jackpot award level and therefore maintain a constant expected return at the jackpot level irrespective of wager.

For the four-credit wager in the FIG. 5*b* example, the average expected return is calculated at each level as follows:

$$(400+800+1200+1600+0)/(4*5)*f=200f \quad \text{Level 1}$$

$$(0+1200+1200+1600+0))/(4*5)*f=200f \quad \text{Level 2}$$

$$(400+800+1200+1600+0)/(4*5)*f*0.8=160f \quad \text{Level 3}$$

One termination symbol was placed at the second level to reduce the probability at the jackpot award level by 20% in proportion to the reduction in wager from five credits to four credits—a 20% reduction. Note that at level three—the next credit-based award level—the formula displays a different expected return. This is due to the effect the termination symbol placed at the selectable position at level two has on level three. The inclusion of the termination symbol at level two reduces the average expected return at not just the jackpot award level, but at all other subsequent levels due to the fact that the player may never reach the subsequent levels should they select the termination symbol. There is a 20 percent chance that the termination symbol will be selected at level two and therefore an 80 percent chance that the player will advance to the next level. The expected return is thus reduced at subsequent levels by 20 percent. But as previously stated, the expected return is designed to remain the same in this embodiment. To ensure this, additional credits are made available to the player at the subsequent credit-based award level (i.e. level three) and the total available award value is increased. At level three in association with a four-credit, to compensate for the 20 percent reduction in average expected return caused by the termination symbol at level two, an increase of 1000 credits was made to the total available award value to adjust the expected return back to the return consistent at that level for each and every credit wager. The formula for level three is thus adjusted to the following:

$$((400+1000)+800+1200+1600+0)/(4*5)*0.8*f=200f \quad \text{Level 3}$$

For a three-credit wager in the FIG. 5*b* example, with the addition of two termination symbols at level two and a credit adjustment of 2000 credits at level three, the expected return is calculated at each level as follows:

$$(300+600+900+1200+0)/(3*5)*f=200f \quad \text{Level 1}$$

$$(0+0+1800+1200+0)/(3*5)*f=200f \quad \text{Level 2}$$

$$((300+2000)+600+900+1200+0)/(3*5)*0.60*f=200f \quad \text{Level 3}$$

For a two-credit wager in the FIG. 5*b* example, with the addition of three termination symbols at level two and a credit adjustment of 3000 credits at level three, the expected return is calculated at each level as follows:

$$(200+400+600+800+0)/(2*5)*f=200f \quad \text{Level 1}$$

$$(0+0+0+2000+0)/(2*5)*f=200f \quad \text{Level 2}$$

$$((200+3000)+400+600+800+0)/(2*5)*0.40*f=200f \quad \text{Level 3}$$

For a one-credit wager in the FIG. 5*b* example, with the addition of four termination symbols at level two and a credit adjustment of 4000 credits at level three, the expected return is calculated at each level as follows:

$$(100+200+300+500+0)/(1*5)*f=200f \quad \text{Level 1}$$

$$(0+0+0+1000+0)/(1*5)*f=200f \quad \text{Level 2}$$

$$((100+4000)+200+300+400+0)/(1*5)*0.20*f=200f \quad \text{Level 3}$$

Note that although all of the added credits to compensate for the prior level termination symbols were all added in the first selectable position, the credits could be spread out in any manner across all of the selectable positions at the given level. Further note that although all of the termination symbols were located within the second credit-based award level and that each level includes five selectable positions, the termination symbols could be located at various levels and the number of selectable positions could vary from level to level. As long as the average expected return remains the same at each level irrespective of wager, the combination of termination symbols and selectable positions can vary in any given embodiment. Last, note that if the termination symbols were added at level three, credit adjustments would not have been necessary since only the expected return at the jackpot award level would be affected. However, to best teach the invention, the terminations were included at level two in this example so that the full affect on expected return at all levels could be illustrated.

The jackpot award level—the fourth level of this bonus game—maintains a set monetary award value irrespective of wager. As previously stated, the termination symbols were included at the credit-based award levels to maintain the expected return at the jackpot award level regardless of wager. As was shown above, the termination symbols affect the expected return at subsequent credit-based award levels. Adjustments were made to maintain the expected return at each level by increasing the total available award value at the subsequent levels. But at the jackpot award level, no adjustments are made in the value of the award. The amount of termination symbols placed at level two were calculated to maintain the expected return at the jackpot level in correlation to the wager made and without affecting the jackpot award value. The expected return at the jackpot award level is calculated according to the following formula:

Where:

J=jackpot award amount

L1factor=selectable positions at level one that allow advance to the next level/total number of selectable positions L2factor=selectable positions at level two that allow advance to the next level/total number of selectable positions L3factor=selectable positions at level three that allow advance to the next level/total number of selectable positions f=bonus game trigger frequency.

g=trigger frequency for winning the jackpot award w=number of credits wagered $$(J*L1\text{factor}*L2\text{factor}*L3\text{factor}*f*g)/w$$

For a five-credit wager in the FIG. 5 example, this provides the following average expected return at the jackpot level:

$$(10{,}000*1*1*1*f*g)/5=2{,}000fg$$

For a four-credit wager in the FIG. 5 example, this provides the following average expected return at the jackpot level:

$$(10{,}000*1*0.80*1*f*g)/4=2{,}000fg$$

For a three-credit wager in the FIG. 5 example, this provides the following average expected return at the jackpot level:

$$(10{,}000*1*0.60*1*f*g)/3=2{,}000fg$$

For a two-credit wager in the FIG. 5 example, this provides the following average expected return at the jackpot level:

$$(10{,}000*1*0.40*1*f*g)/2=2{,}000fg$$

For a one-credit wager in the FIG. 5 example, this provides the following average expected return at the jackpot level:

$$(10{,}000*1*0.20*1*f*g)/1=2{,}000fg$$

For each credit wager amount, the expected return remains the same—2000fg. Both f and g are set constants and will not change with wager.

The present invention further includes the ability to simultaneously link multiple, different gaming machines having the same or different numbers of possible payline selections (including different maximum payline selection amounts) to a system that controls aspects of a jackpot award while providing the same probability of winning the jackpot award once the jackpot award level is reached, regardless of the number of paylines selected and wager per payline (i.e. total wager). Therefore, regardless of the number of paylines selected, the expected return at the jackpot award level remains constant. This is achieved by adjusting the probability of reaching the jackpot award level on either one or more gaming machines having a lesser amount of selected paylines than one or more gaming machines having a greater amount of selected paylines or, vice versa, on the one or more gaming machines having the greater amount of selected paylines than the one or more gaming machines having lesser amount of selected paylines. It is also possible to make the adjustment to both sets of gaming machines in a proportional manner to achieve the same end. In the preferred embodiment, the maximum number of selectable paylines must be selected on the gaming machine, regardless of what that amount may be on the particular linked gaming machine, in order to provide the conditions for extending the same expected return at the jackpot award level. Adjustment to the probability of reaching the jackpot award level is achieved through the use of termination symbols at preceding credit-based award levels. This is done in a manner similar to the use of termination symbols for controlling the expected return at the jackpot award level in non-linked gaining machines. Thus, a first gaming machine having a given number of selected paylines in the base game would have twice the probability of reaching the jackpot award level as a second gaming machine having half the number of selected paylines for the same credits bet per line. In the preferred embodiment, this would mean that the maximum number of selectable paylines on the first gaming machine would be twice the number of maximum selectable paylines on the second gaming machine. One or more termination symbols would be programmed into the second gaming machine bonus game at mathematically prescribed location(s) to reduce the probability of reaching the jackpot award level by half. This adjustment ensures that the constant expected return is maintained. For twice the number of selected paylines, the player is receiving double the chance of reaching the jackpot award level as the player selecting only half the number of selected paylines. The adjustment is dependent on denomination. Therefore, the adjustment is only provided as between variable numbers of selected paylines when the same denomination is selected as between the two gaming machines. A player making a five credit per payline wager on a 50 payline game would receive twice the probability of reaching the jackpot award level as a player making a five credit per payline wager on a 25 payline game, but only if the credit is based on the same denomination. The same holds true if the player is making a one credit per payline wager, a two credit per payline wager or any other amount up to the maximum credit per payline wager accepted by the gaming machine. The jackpot award, similar to the jackpot awards available in the singular gaming machines not linked to a system, can be a set monetary or credit prize, a physical item such as a car, or progressive jackpot that grows over time through contributions made from the player's base game wager or ante-bet wager, or other type of award that changes in value with time; albeit a change similarly applied to every gaming machine linked to the network.

It is to be understood that each of the aforementioned embodiments are not to be construed as limiting, but rather as being exemplary of alternative ways of delivering the invention. As such, variations on the above not explicitly provided herein are within the scope of the present invention.

While the invention has been illustrated with respect to the specific embodiments thereof, these embodiments should be considered as illustrative rather than limiting. Various modifications and additions may be made and will be apparent to those skilled in the art.

The invention claimed is:

1. A gaming device comprising:

(a) an input module for receiving a wager requisite for playing a game of chance having a plurality of selectable paylines;

(b) a processor for processing instructions stored at one or more memory storage locations;

(c) an input device for providing data for use by the processor; and (d) a display module for displaying the game of chance; wherein (i) the instructions stored in the one or more memory storage locations are executed by the processor after input of the wager through the input module and the input of data through the input device; the data including aspects of the wager comprising a selected denomination from a plurality of denominations, one or more selected paylines from the plurality of selectable paylines; and an amount associated with each of the one or more selected paylines;

(ii) a trigger condition in the game of chance causes a bonus game to be displayed in the display module when the trigger condition is met, the bonus game comprising a plurality of levels with each level having a distinct outcome, at least one level providing credit-based awards and one level providing a jackpot award wherein the at least one level providing credit-based awards precedes the jackpot award level and the distinct outcome at the at least one level providing credit-based awards includes an advance to the next level in the plurality of levels or a termination of the bonus game, wherein the probability of achieving the distinct outcome associated with an advance to the next level increases with an increase in wager and the credit-based awards increase in value with an increase in the wager associated with each of the one or more selected paylines while the jackpot award is of constant value and a constant expected return irrespective of the wager or the number of one or more selected paylines.

2. The gaming device of claim 1, wherein:

the jackpot award is a progressive jackpot that increases in value over time but is a set value at any given moment in time.

3. The gaming device of claim 1, wherein another aspect of the wager includes an ante bet that fully funds the bonus game.

4. The gaming device of claim 1, wherein the jackpot award of constant value has an increased probability of entering the jackpot award level with an increase in wager.

5. The gaming device of claim 1, wherein:

the termination of the bonus game occurs when the distinct outcome is associated with a terminating event.

6. The gaming device of claim 5, wherein:

(a) each of the at least one credit-based award levels includes a total available award value accumulated from the plurality of outcomes; and (b) the total available award value at each of the at least one credit-based award levels is proportionally increased with an increase in wager and, at those at least one credit-based award levels subsequent to credit-based award levels having said terminating event as at least one of the distinct outcomes, is further increased to retain the same expected return at each of those subsequent credit-based award levels and in the bonus game.

7. The gaming device of claim 6, wherein:

the total available award value at one or more of the at least one credit-based award levels is adjusted in value with variations in wager to maintain an expected return in the bonus game that increases with an increase in wager.

8. The gaming device of claim 5, wherein:

the terminating event is a termination symbol that is selected from a plurality of selectable positions.

9. The gaming device of claim 5, further comprising:

a frequency associated with the trigger condition that controls how often the trigger condition is met, wherein:

the frequency is modified in relation to the wager to effect the expected return of the bonus game.

10. A method of operating a gaming device having an input module, computer code stored in at least one memory module, at least one processor and a display module, comprising:

(a) wagering a first amount through the input module to play a game of chance, the amount associated with a selected denomination, a per-payline wager, and one or more selected paylines;

(b) receiving a chance at triggering a bonus game;

(c) playing a game of chance through the execution of the computer code stored at the at least one memory module by the at least one processor;

(d) displaying the game of chance on the display module;

(e) triggering the display of a bonus game upon the occurrence of a triggering event;

(f) providing a chance to win a jackpot award in the bonus game wherein the jackpot award remains at constant value and independent of the per-payline wager of the one or more selected paylines;

(g) providing the bonus game on the display module with a plurality of playable levels each with a distinct outcome, each playable level providing either a credit-based award or a jackpot award and playable sequentially with the jackpot award level playable after at least one credit-based award level;

(h) maintaining a constant expected return at the jackpot award level irrespective of wager;

(i) providing a plurality of outcomes at each of the at least one credit-based award levels including an advance to the next level in the plurality of levels or one, none or a plurality of terminating events that if selected cause the bonus game to terminate, wherein the probability of achieving the distinct outcome associated with an advance to the next level increases with an increase in wager; and (j) including the terminating events in the at least one credit-based award levels in quantities and at levels necessary to maintain the jackpot award level of set value and constant expected return irrespective of wager.

11. The game method of claim 10, further comprising:

(a) wagering a second amount through the input module to receive the chance at triggering a bonus game; and (b) triggering the bonus game upon the occurrence of a triggering event if said second amount was optionally wagered.

12. The gaming method of claim 10, wherein the probability of entering the jackpot award level increases with an increase in wager.

13. A gaming system comprising:

a plurality of gaming devices of claim 3 in communication through a network, wherein:

(a) aspects of the jackpot award are controlled through the network, including delivery of the constant value associated with the jackpot award to any of the plurality of gaming devices upon a winning outcome associated with the jackpot award;

(b) at least one of the plurality of gaming devices has a different number of selected paylines from the plurality of selectable paylines from at least one other of the plurality of gaming devices, and (c) an adjustment is made to the probability of reaching the jackpot award level on at least one of the plurality of gaming devices to maintain the constant expected return at the jackpot award level for all of the plurality of gaming devices.

14. The gaming system of claim 13, wherein:

the adjustment is made to the at least one of the plurality of gaming devices having a lesser number of selected paylines by including one or more termination symbols at the credit-based award levels that precede the jackpot award level.

15. The gaming system of claim 13, further comprising:

a frequency associated with the trigger condition that controls how often the trigger condition is met, wherein:

the frequency is modified in relation to the wager to effect the expected return of the bonus game.

* * * * *